US005708923A

United States Patent [19]

Duval et al.

[11] Patent Number: 5,708,923

[45] Date of Patent: Jan. 13, 1998

[54] PHOTORECEPTIVE SHEET CARTRIDGE AND METHOD OF USING THE SAME

[75] Inventors: Ty A. Duval, Atlanta, Ga.; Thomas W. Reeder, Arden, N.C.

[73] Assignee: Minnesota Mining and Manufacturing Company, St. Paul, Minn.

[21] Appl. No.: 497,148

[22] Filed: Jul. 30, 1995

[51] Int. Cl.[6] ..... G03G 21/00

[52] U.S. Cl. ..... 399/116; 399/159

[58] Field of Search ..... 355/213, 211, 355/212

[56] References Cited

U.S. PATENT DOCUMENTS

| | | |
|---|---|---|
| 3,697,160 | 10/1972 | Clark . |
| 3,792,924 | 2/1974 | Matsuda et al. . |
| 3,826,570 | 7/1974 | Kolibas . |
| 3,877,806 | 4/1975 | Schrempp et al. . |
| 3,926,625 | 12/1975 | van der Sterren . |
| 3,984,241 | 10/1976 | Schrempp et al. . |
| 4,051,986 | 10/1977 | Tiggelers et al. . |
| 4,057,344 | 11/1977 | Wick et al. . |
| 4,088,403 | 5/1978 | Kingsley . |
| 4,097,138 | 6/1978 | Kingsley . |
| 4,192,603 | 3/1980 | Buck . |
| 4,198,155 | 4/1980 | Silverberg . |
| 4,215,932 | 8/1980 | Castelli et al. . |
| 4,475,979 | 10/1984 | Idstein et al. . |
| 4,728,983 | 3/1988 | Zwadlo et al. . |
| 5,119,133 | 6/1992 | Swain . |
| 5,267,001 | 11/1993 | Kanai et al. . |
| 5,357,318 | 10/1994 | Haneda et al. . |
| 5,420,670 | 5/1995 | Fukuoka et al. . |

FOREIGN PATENT DOCUMENTS

| | | |
|---|---|---|
| 60-195580 | 10/1985 | Japan . |

*Primary Examiner*—R. L. Moses
*Attorney, Agent, or Firm*—William K. Weimer

[57] ABSTRACT

A cartridge can contain a photoreceptive sheet(s), allow for the introduction of the photoreceptive sheet to an imaging apparatus, and receive the photoreceptive sheet from the imaging apparatus. The cartridge can store the photoreceptive sheet(s) in a curved form or in a flat form. The cartridge can include internal rollers for driving the photoreceptive sheet in and/or out of the cartridge.

14 Claims, 7 Drawing Sheets

PHOTORECEPTIVE SHEET CARTRIDGE AND METHOD OF USING THE SAME

FIELD OF THE INVENTION

The present invention is directed generally to an apparatus and method for electrophotographic printing. In particular, the present invention is directed to an apparatus and method for electrophotographic printing using a cartridge for an easily exchangeable photoreceptor.

BACKGROUND OF THE INVENTION

An electrophotographic apparatus includes several systems, including a latent image-forming system, which applies a uniform potential to a photoreceptive material. The latent image-forming system then applies light to the photoreceptive material in an image-wise pattern to create a latent image corresponding to an image held within the electrophotographic apparatus or some other image source. The image held by the electrophotographic apparatus can be acquired, for example, from an original document or copy sheet, or from desktop publishing computer software.

A toner deposition system within the electrophotographic apparatus applies a conductive, solid or liquid toner to the photoreceptive material which collects on photoreceptive material in a pattern similar to image-wise pattern. A transfer system transfers the inked image from the photoreceptive material either directly onto a final substrate, such as a sheet of paper, or onto an intermediate substrate before being subsequently transferred to the final substrate.

A first transport mechanism transports the photoreceptive material within the electrophotographic apparatus and through the previously mentioned systems. In addition, a second transport mechanism transports the input sheet to and from the toner transfer mechanism.

Commonly, the photoreceptive material is a material which is coated onto a drum or belt, depending on the type of electrophotographic apparatus. After numerous passes within the electrophotographic apparatus, the photoreceptive material can require replacement. When the photoreceptive material is coated onto the drum, replacing the photoreceptive material requires replacing the entire drum, which can be costly and difficult to accomplish.

When the photoreceptive material is coated onto a belt, replacement cost is reduced in comparison. However, removing the spent belt and replacing it with a new belt requires disassembly of the belt transport mechanism, which is difficult and time-consuming If, however, the belt transport mechanism is made using cantilevered rollers, disassembly is simplified. But, a cantilevered belt transport mechanism is more complex and requires significant structural support within the electrophotographic apparatus to provide a sufficiently stable transport path for the belt. Such support adds cost, size, and weight to the electrophotographic apparatus.

In addition, a belt inherently includes a seam. Seams are often made by thermally fusing the two ends of a web together. This, of course, limits the type of material of which the belt may be constructed, namely, thermally fusible material. Plus, because seaming creates irregularities in the photoreceptive material along the seam, the quality of the image can be adversely affected when the image is imposed across the seam.

U.S. Pat. No. 4,088,403 (inventor: Kingsley) discloses coating the photoreceptive material onto a length of carrier material to create a photoconductive belt. The belt must be stretched around a sub-belt so that the photoconductive belt is under tension and so that the ends of the belt are brought together or overlap each other to form a joined belt. The leading and trailing edges are either adhered to the sub-belt or are attached to each other with means such as adhesive or a hook-and-loop fastener. With this construction, the photoconductive belt can be wrinkled or excessively stretched as it is transported with the sub-belt. In addition, this photoconductive belt is not easily removed and replaced with a new belt within the apparatus in which it functions, such as an electrophotographic apparatus.

SUMMARY OF THE INVENTION

The present invention overcomes these problems by providing a cartridge for use with an imaging apparatus which has a photoreceptive sheet-transporting mechanism. The cartridge includes a housing and a photoreceptive sheet within the housing, the photoreceptive sheet being capable of capturing and storing an electrostatic image. The housing is positionable relative to the photoreceptive sheet-transporting mechanism such that the photoreceptive sheet can be dispensed from the housing and transported through a portion of the imaging apparatus.

Another embodiment of the present invention includes a method for introducing a photoreceptive sheet to an imaging apparatus. The method includes the step of providing a cartridge containing the photoreceptive sheet. Another step includes providing a sheet-transporting mechanism within the imaging apparatus. The sheet-transporting mechanism is capable of removing the photoreceptive sheet from the cartridge and transporting the photoreceptive sheet within the imaging apparatus.

Another embodiment of the present invention includes an imaging apparatus. This apparatus includes an apparatus housing. A sheet-transporting mechanism is positioned within the housing. A photoreceptive sheet positionable within the housing. The photoreceptive sheet is transportable through a sheet path by the sheet-transporting mechanism. A sheet cartridge is positionable within the housing for storing the photoreceptive sheet and from which the photoreceptive sheet can be removed when transported by the sheet-transporting mechanism.

Another embodiment of the present invention is a cartridge adapted for storing the photoreceptive sheet for allowing the photoreceptive sheet to be dispensed to a sheet-transporting mechanism within an imaging apparatus. The cartridge includes a housing which defines a first chamber in which the photoreceptive sheet can be stored. The housing has an outlet functionally communicating with the first chamber and the sheet-transporting mechanism. The first chamber is shaped such that the photoreceptive sheet is substantially flat when stored within the first chamber.

Another embodiment of the present invention is a cartridge adapted for storing the photoreceptive sheet for allowing the photoreceptive sheet to be dispensed to a sheet-transporting mechanism within an imaging apparatus. The cartridge includes a housing which defines a first chamber in which the photoreceptive sheet can be stored. The housing has an outlet functionally communicating with the first chamber and the sheet-transporting mechanism. The housing further defines a second chamber in which the photoreceptive sheet can be stored after the photoreceptive sheet is transported by the sheet-transporting mechanism. The housing has an inlet functionally communicating with the second chamber and the sheet-transporting mechanism.

Another embodiment of the present invention is a cartridge adapted for storing the photoreceptive sheet for allowing the photoreceptive sheet to be dispensed to a sheet-transporting mechanism within an imaging apparatus. The imaging apparatus includes a transporting component for transporting the sheet within the apparatus. The cartridge includes a housing which defines a first chamber in which the photoreceptive sheet can be stored, The housing has an outlet functionally communicating with the first chamber and the sheet-transporting mechanism. A plurality of sheet-driving rollers within the cartridge drive the photoreceptive sheet from the cartridge. The plurality of sheet-driving rollers are configured to feed the expended photoreceptive sheet from the apparatus into the second chamber, The plurality of sheet-driving rollers includes at least four rollers. A first roller extends from the cartridge and is driveable by the transporting component. A second roller is positioned adjacent to and driveable by the first roller. A third roller is positioned adjacent to and driveable by the second roller and is positioned within the cartridge to contact and drive the sheet from the first chamber. A fourth roller is positioned adjacent to and driveable by the second roller and is positioned to drive the expended sheet to the second chamber.

Another embodiment of the present invention is a method for introducing a photoreceptive sheet to an imaging apparatus. The method includes the step of providing a cartridge containing the photoreceptive sheet. The cartridge includes a housing defining a first chamber and a second chamber for storing at least one photoreceptive sheet. Another step involves providing a sheet-transporting mechanism within the imaging apparatus. The sheet-transporting mechanism is capable of removing the photoreceptive sheet from the cartridge and transporting the photoreceptive sheet within the imaging apparatus.

Another embodiment of the present invention is a photoreceptive sheet holder adapted for storing at least one photoreceptive sheet for use within an imaging apparatus. The photoreceptive sheet holder includes at least one sheet-contacting surface. The at least one sheet-contacting surface causes the at least one photoreceptive sheet to be substantially flat when held by the photoreceptive sheet holder.

Another embodiment of the present invention is a photoreceptive sheet holder adapted for storing a plurality of photoreceptive sheets for use within an imaging apparatus. The photoreceptive sheet holder includes at least one sheet-contacting surface. The at least one sheet-contacting surface causes the plurality of photoreceptive sheets to be stacked together when held by the sheet holder.

BRIEF DESCRIPTION OF THE DRAWINGS

The foregoing advantages, construction, and operation of the present invention will become more readily apparent from the following description and accompanying drawings in which.

DETAILED DESCRIPTION OF PREFERRED EMBODIMENTS

Figure 1:
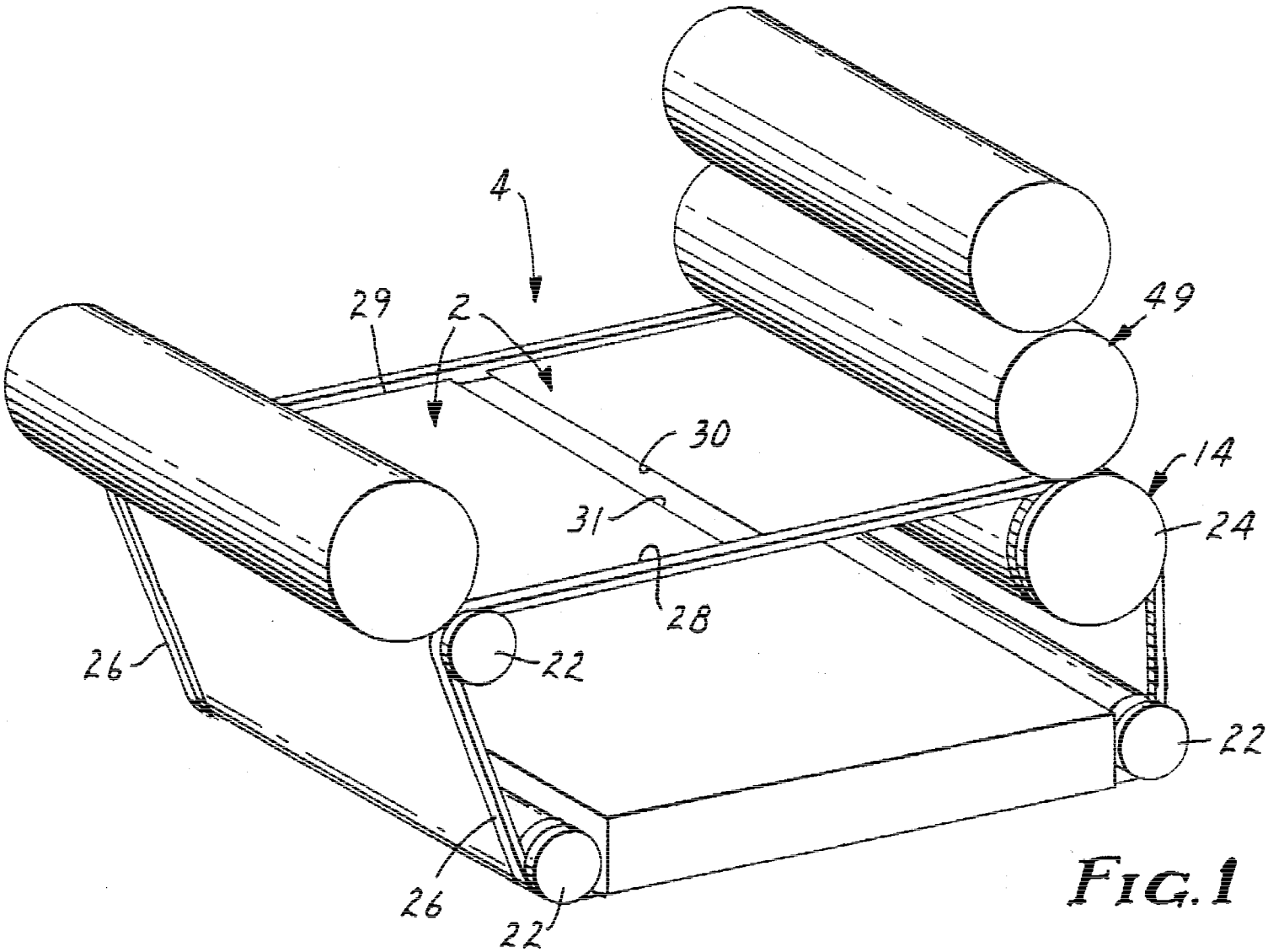
FIG. 1 is a perspective view of a photoreceptive sheet fastened to a transport mechanism within an electrophotographic apparatus.
Figure 2:
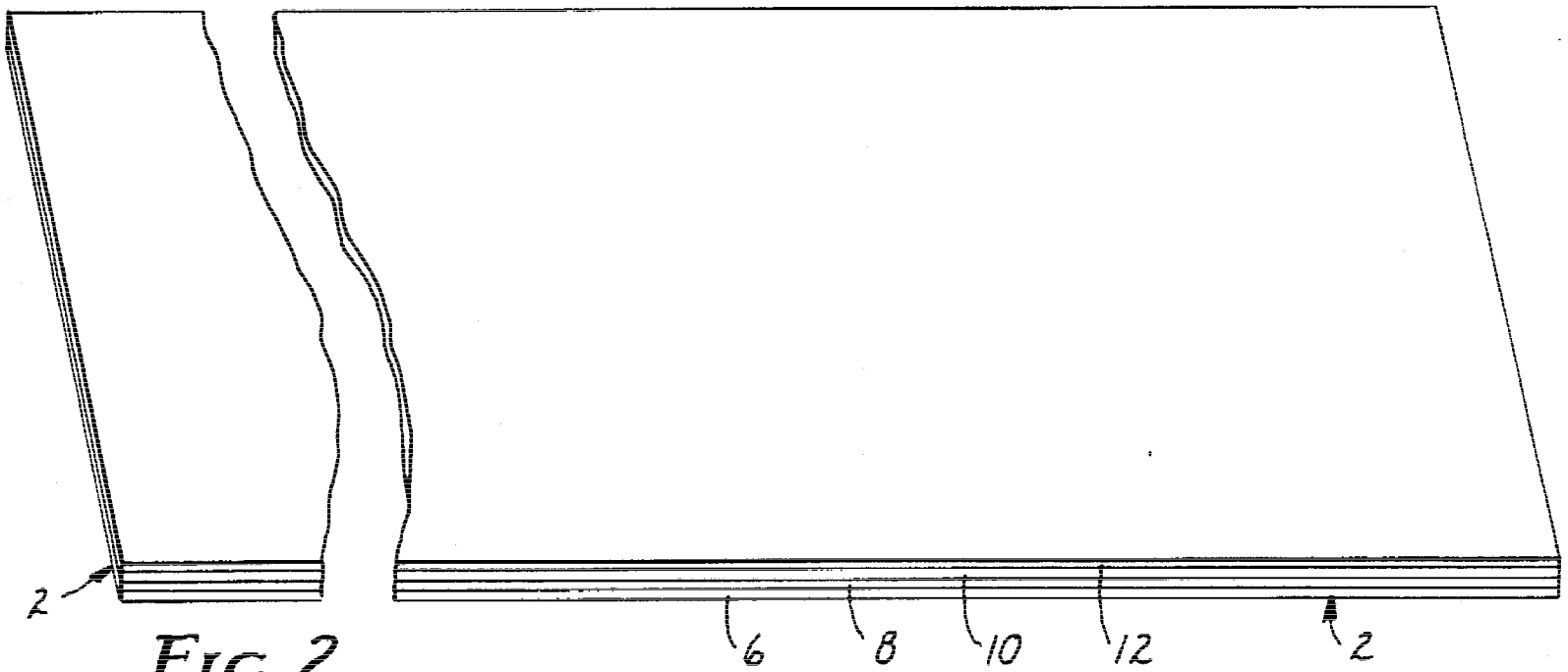
FIG. 2 is a partial perspective view of one embodiment of the photoreceptive sheet.

A photoreceptor, shown as a photoreceptive sheet in FIG. 1, is adapted for use within an electrophotographic apparatus 4. The photoreceptive sheet 2 can be adapted for repeated use within the electrophotographic apparatus 4. One embodiment of the photoreceptive sheet 2 can be made of the same materials used to make known photoreceptive belts. A specific embodiment of the photoreceptive sheet 2 is shown in FIG. 2 as being a multi-layer sheet. The multi-layers include a base sheet 6, a photoreceptive layer 8, a barrier layer 10, and a release layer 12. The base sheet 6 can be, for example, a polyester film and have a 0.004 inch (0.010 centimeter) thickness. The base sheet 6 could instead be a polyamide film or a metal-coated film, such as an Aluminum vapor-coated polyester film (1% light transmissive vapor coating). The photoreceptive layer 8 can be approximately 15 microns thick and include materials such as azo pigments, molecular complexes, perylene pigments, phthalocyanine pigments, squaraine pigments, or other known materials. The photoreceptive layer 8 can be applied by die-coating these photoreceptive materials onto the base sheet 6. The barrier layer 10 can be approximately 0.2 microns thick and made of materials such polyvinylbutyrl resin. The barrier layer 10 can be applied by die-coating the polyvinylbutyrl resin onto the photoreceptive layer 8. The release layer 12 can be made of a silicone and have a thickness of approximately 0.65 microns. The release layer can be applied by die-coating the silicone onto the barrier layer 10.

Unlike a photoreceptive belt, the photoreceptive sheet 2 need not be seamed to function properly. Consequently, the material choices are not limited to seamable material, such as a thermally fusible material.

The photoreceptive sheet 2 can be repeatedly transported through a transport loop within the electrophotographic apparatus 4 by a first transport mechanism 14. The transport loop can have, for example, a rectangular shape, a circular shape, or another shape. The transport loop can have a transport loop distance, that is, the distance around the transport loop. The first transport mechanism 14 can include multiple idler rollers 22, a drive roller 24, and at least one transporting component.

Figure 3:
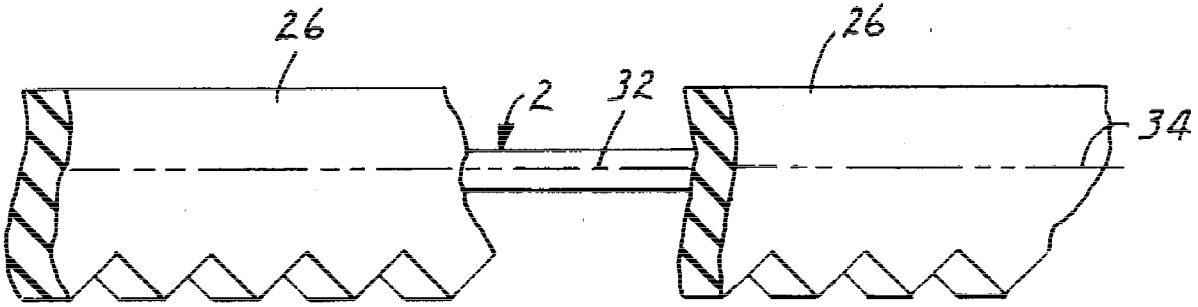
FIG. 3 is a partial perspective view of the photoreceptive sheet shown in FIG. 2 aligned with and fastened to a timing belt.

The transporting component can be a belt 26, although other transporting components could be used. As shown in FIG. 3, the belt can be an edge belt, such as a timing belt. With an edge belt, a substantial portion of the photoreceptive sheet 2 is not supported by another component, such as a full-width belt (not shown).

Two belts 26 can form the transport loop by riding over the idler rollers 22 and the drive roller 24. The drive roller 24 can mate with and drive the belts 26. The belts 26 can be fastenable to, or in some other way functionally coupleable to, the side edges 28, 29 of the photoreceptive sheet 2 to transport photoreceptive sheet 2 through the transport loop.

The transporting component could be designed to be fastenable to at least a portion of leading edge 30 of the photoreceptive sheet rather than, or in addition to, the side edges 28, 29. Similarly, the transporting component could be designed to also be fastenable to the trailing edge 31 of the photoreceptive sheet 2.

To minimize wrinkling the photoreceptive sheet 2 during transport, the center plane 32 of the photoreceptive sheet 2 should be aligned with the center plane 34 of each of the belts 26, as shown in FIG. 3. To accomplish this alignment, each belt 26 can be fastenable to the photoreceptive sheet 2 using one of the fastening webs 36A, 36B as shown in FIGS. 4 and 5.

Figure 4:
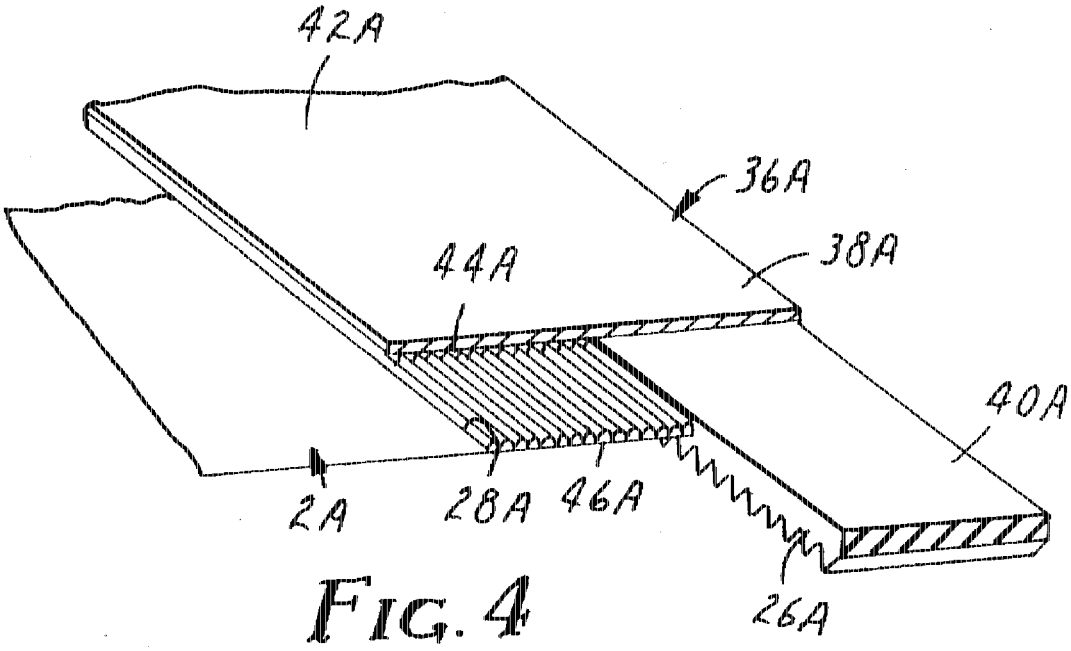
FIG. 4 is a partial perspective view of the attachment of the photoreceptive sheet to the timing belt shown in FIG. 3.

As shown in FIG. 4, a first portion 38A of the fastening web 36A can be connected to the top surface 40A of one of the belts 26A. A second portion 42A of the fastening web 36A extends from beyond the belt 26A and includes a fastening surface 44A which can be repeatedly fastened to and unfastened from a fastening surface 46A near one of the side edges 28A, 30A and on the top surface 47A of the photoreceptive sheet 2A. Using this fastening web 36A, the photoreceptive sheet 2A can be delivered to the belts 26A from below the belts 26A.

Figure 5:
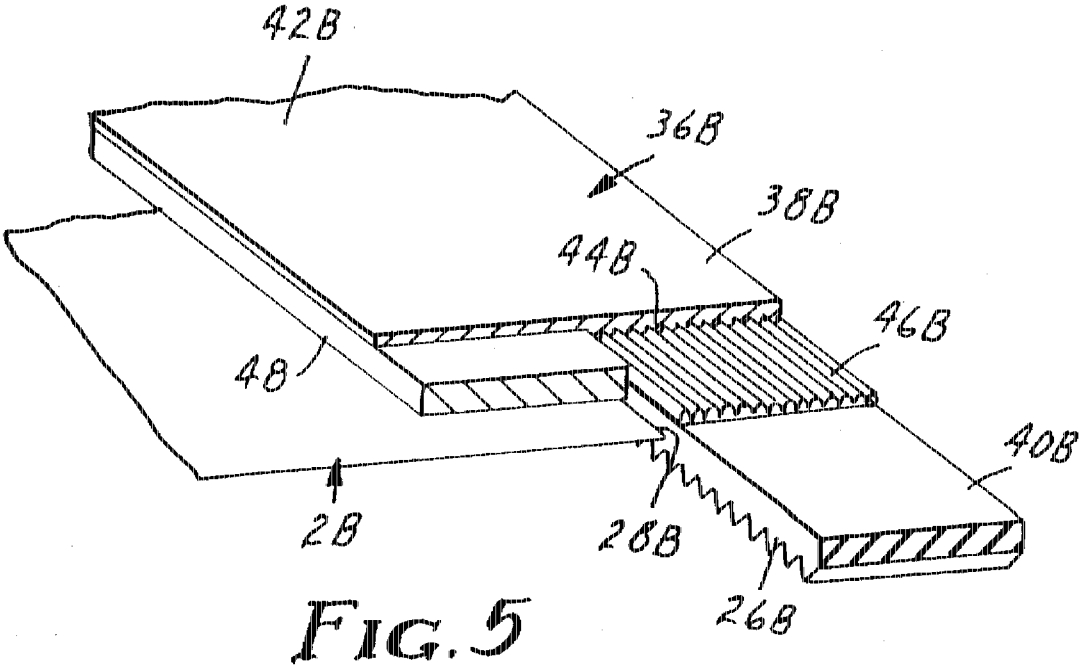
FIG. 5 is a partial perspective view of another embodiment of the attachment shown in FIG. 4.

As shown in FIG. 5, an alternative embodiment of the fastening web 36B can be used in place of the previously described fastening web 36A. A fastening surface 44B on the first portion 38B of the fastening web 36B can be fastened to, unfastened from, and refastened to a fastening surface 46B located on the top surface 40B of the belt 26B. The second portion 42B of the fastening web 36B can be connected to the photoreceptive sheet 2B. To properly align the center plane 32 of the photoreceptive sheet 2B and the center plane 34 of the belts 26B, a spacer 48 can be used between the photoreceptive sheet 2B and the second portion 42B of the fastening web 36B. The refastenability of the fastening surfaces 44B, 46B allow for removal and replacement of the photoreceptive sheet 2B and fastening web 36B from the belts 26B. Using this fastening web 36B, the photoreceptive sheet 2B can be delivered to the belts 26A from above the belts 26A.

The refastenable fastening surfaces 44A, 46A can be microstructured surfaces, adhesive-based surfaces, or some other similarly performing surfaces. An example of an adhesive-based surface could be an adhesive tape which loses adhesion when stretched. This type of tape can be referred to as "stretch-and-release" tape.

The refastenable fastening surfaces 44A, 46A can be formed as part of the photoreceptive sheet 2A or the fastening web 46A, or can be a separate component connected to photoreceptive sheet 2A or the fastening web 46A.

The refastenable fastening surfaces 44A, 46A can be constructed so that when joined, the center plane 32 of the photoreceptive sheet 2A and the center plane 34 of each of the belts 26A are properly aligned. The refastenability of the fastening surfaces 44A, 46A allow for removal and replacement of the photoreceptive sheet 2A from the belts 26A and fastening web 36A. To firmly fasten the refastenable fastening surfaces 44, 46 to the belts 26, the photoreceptive sheet 2 and the belts can be driven between a pair of nip rollers, such as drive roller 24 and top roller 49.

Although the first portion 42A and the second portion 42B of the fastening web 36A, 36B, respectively, were previously referred to as being "connected" to the top surface 40A of the belt 26A and to spacer 48, respectively, the connection need not be permanent. The connection of these components is sufficiently secure if more secure than the fastening of the refastenable fastening surfaces 44, 46.

The length of the photoreceptive sheet 2 can be chosen so that when the photoreceptive sheet 2 is fastened to the belts 26, the leading edge 50 of the photoreceptive sheet 2 does not reach around the transport loop to meet the trailing edge 51 of the photoreceptive sheet 2. This creates a gap 52 between the trailing edge 50 and leading edge 51. Alternatively, the length of the photoreceptive sheet 2 can be chosen so that the leading edge 50 either abuts or overlaps the trailing edge 51. In this case, a gap 52 can be avoided, if desired. Preferably, the photoreceptive sheet 2 is not stretched when fastened to the belts 26.

Figure 6:
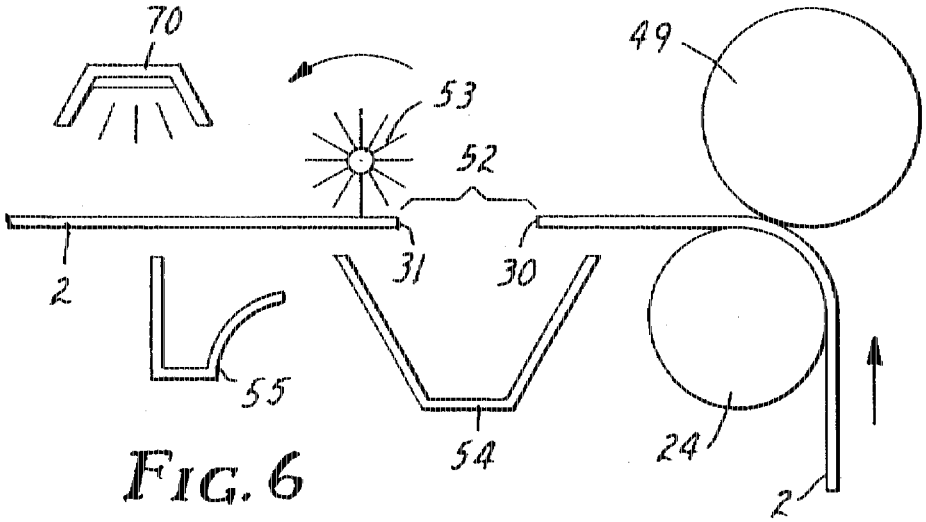
FIG. 6 is a partial side view of the photoreceptive sheet shown in FIG. 2, a sheet-directing mechanism, a brush, and a container.

The gap 52 between the leading and trailing edges 50, 51 can provide numerous advantageous. First, because the photoreceptive sheet 2 is made of materials the cost of which are not insignificant, minimizing the length of photoreceptive sheet 2 is cost-effective. Second, when an amount of ink remains on the photoreceptive sheet 2 after the bulk of the ink is transferred from the photoreceptive sheet to another substrate (such as a sheet of paper), a sheet brush 53 can be included within the electrophotographic apparatus 4 to brush the excess ink to the gap 52 and into a container 54, as shown in FIG. 6. The brush 53 could be, for example, stationary or rotating. Or, the brush 53 could be replaced by a stationary blade (not shown), or another means for removing the remaining ink.

Third, the gap 52 allows for a sheet directing mechanism 55 within the electrophotographic apparatus 4 to, for example, contact the leading edge 50 and remove the photoreceptive sheet 2 from the transport mechanism 14. This sheet-directing mechanism 55 could direct the photoreceptive sheet 2 into a sheet container 56, shown in FIG. 6.

The size of the gap 54 can be chosen to provide one or more of the previously noted advantages. The gap 54 can be, for example, two centimeters or greater. To create the gap 54, the length of the photoreceptive sheet 2 can be, for example, 98% of the length of the belts 26, or less.

Rather than using the previously described sheet-transporting mechanism, the photoreceptive sheet 2 can be transported by being attached to (and removable from) a rotating drum (not shown). The size of the sheet 2 and the drum can be chosen to create a gap between the ends of the photoreceptive sheet 2. The other previously described features could be modified to function with a rotating drum rather than the edge belts 26.

Figure 7:
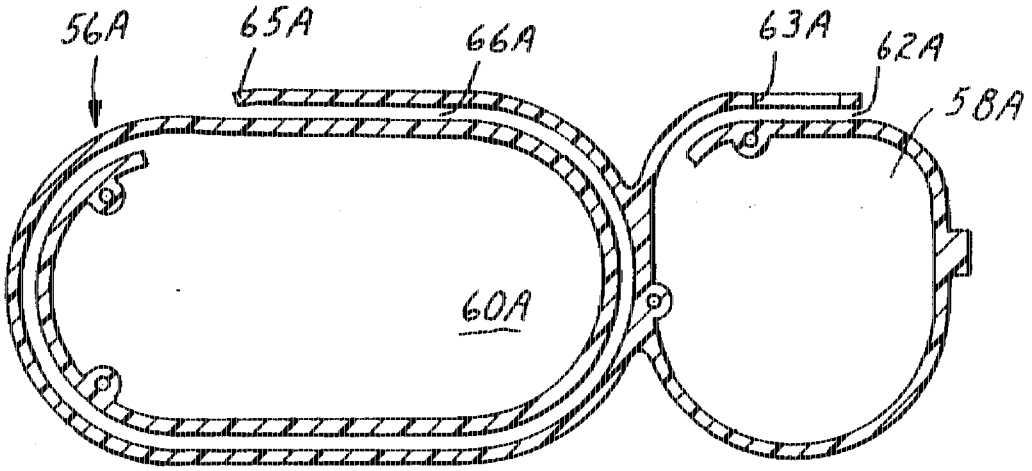
FIG. 7 is a side sectional view of a sheet cartridge containing the photoreceptive sheet of FIG. 2.
Figure 8:
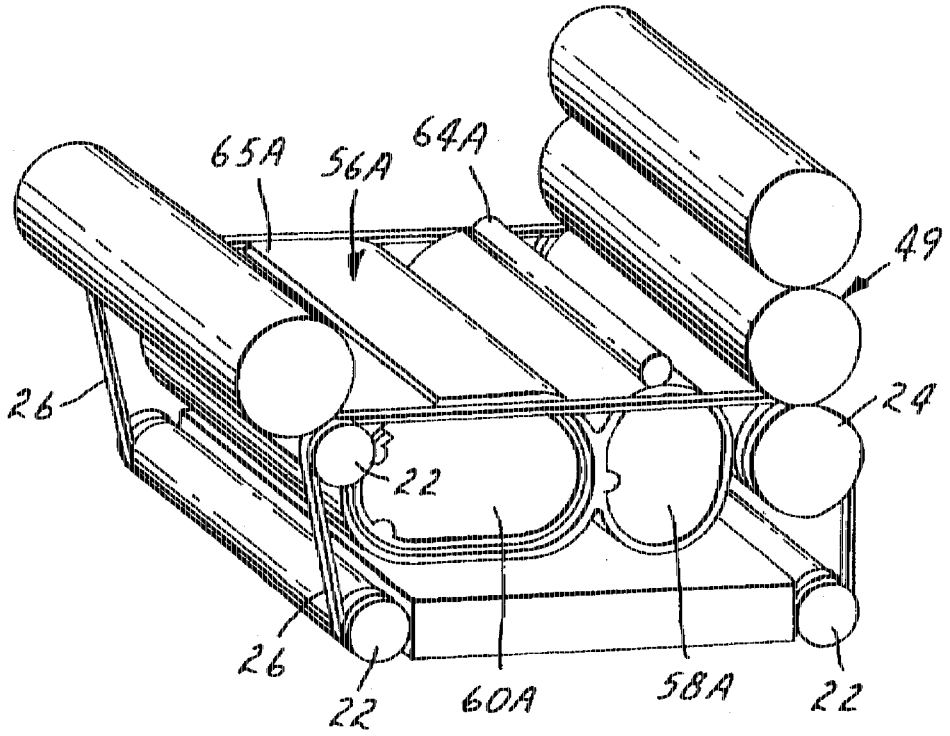
FIG. 8 is a perspective view of the sheet cartridge shown in FIG. 7 positioned within a transport mechanism of an electrophotographic apparatus.

The photoreceptive sheet 2 can be delivered to the first transport mechanism 14 from the sheet cartridge 56. The sheet cartridge 56 can be an injection-molded article being moldable from a variety of injection-moldable resins. As shown in FIGS. 7 and 8, one embodiment of the sheet cartridge 56A can be constructed to work in conjunction with the orientation of the photoreceptive sheet 2A, belts 26A, and fastening web 36A shown in FIG. 4. As shown in FIG. 8, the sheet cartridge 56A can include a housing 57A which defines a first chamber 58A for storing and allowing the dispensing of a new photoreceptive sheet 2A, and defining a second chamber 60A for receiving and storing an expended photoreceptive sheet 2A.

The cartridge can include an outlet 62A which functionally communicates with the first chamber 58A and the electrophotographic apparatus 4A. In other words, the new photoreceptive sheet 2A can move from the first chamber 58A to the electrophotographic apparatus 4A.

As shown in FIG. 8, the sheet cartridge 56A is positionable within the zone created by the belts 26A so that the photoreceptive sheet 2A can be properly presented and fastened to the belts 26A. When the sheet cartridge 56A is inserted and the electrophotographic apparatus 4A is actuated, the portion of the new photoreceptive sheet 2A which extends from the first chamber 58A can be driven out of the first chamber 58A and to the belts 26A. The outlet 62A can include a slot roller groove 63A through which a sheet driving roller 64A can fit to drive the new photoreceptive sheet 2A from the first chamber 56A. After the photoreceptive sheet 2A is dispensed, the sheet cartridge 56A can be removed from the electrophotographic apparatus 4A.

After some number of uses, the photoreceptive sheet 2A can become expended, or the user may simply want to replace it. The electrophotographic apparatus 4 can include a directing member 65A to direct the expended photoreceptive sheet 2A through an inlet 66A and into the second chamber 60A. A new photoreceptive sheet 2A can be immediately or simultaneously dispensed from the first chamber 58A in the new sheet cartridge 56A. The directing member 65A can be, for example, operated manually by a user or automatically by a mechanism (not shown) within the electrophotographic apparatus 4A. The directing member 65A within the sheet cartridge 56A could replace the previously described sheet directing mechanism 55 or could work in conjunction with the sheet directing mechanism 55.

The first chamber 58A and the second chamber 60A can each be of a size to house more than a single photoreceptive sheet 2. Therefore, when a sheet 2A becomes expended, the sheet 2A could be directed into the second chamber 60A and a new sheet 2A can be withdrawn from the first chamber 58A.

Because the photoreceptive sheet 2A can be in sheet-form when inserted, used, and removed from the transport system 14, the new and the expended sheets 2A can be curved or even rolled up within the first chamber 58A and the second chamber 60A, respectively. A rolled photoreceptive sheet 2A takes up far less space than a folded, uncreased photoreceptive belt. Consequently, the sheet 2A allows the sheet cartridge 56 to be an efficient storage and delivery means for the electrophotographic apparatus 4A.

The cartridge 56 can be shaped such that the photoreceptive sheet 2A is stored in a flat form within the first chamber 58A and/or second chamber 60A, rather than being in a curved form. This could be advantageous for a construction of the photoreceptive sheet which is better preserved when stored in a flat form. For example, one construction of a photoreceptive sheet stored in, for example, a rolled form for a long period of time may be less easily transported than one stored for a long period of time in a flat form. This advantage may be particularly important for storing a plurality of photoreceptive sheets in a flat form.

In addition to storage advantages, the photoreceptive sheet 2A can more easily be inserted into and removed from the transport system 14A than a photoreceptive belt. Being inserted from the sheet cartridge 56, as previously noted, does not require the removal of roller supports, unlike when a belt is inserted. Plus, inserting and removing a sheet 2A from the transport system 14 do not require the use of heavy-duty, cantilevered rollers.

Figure 9:
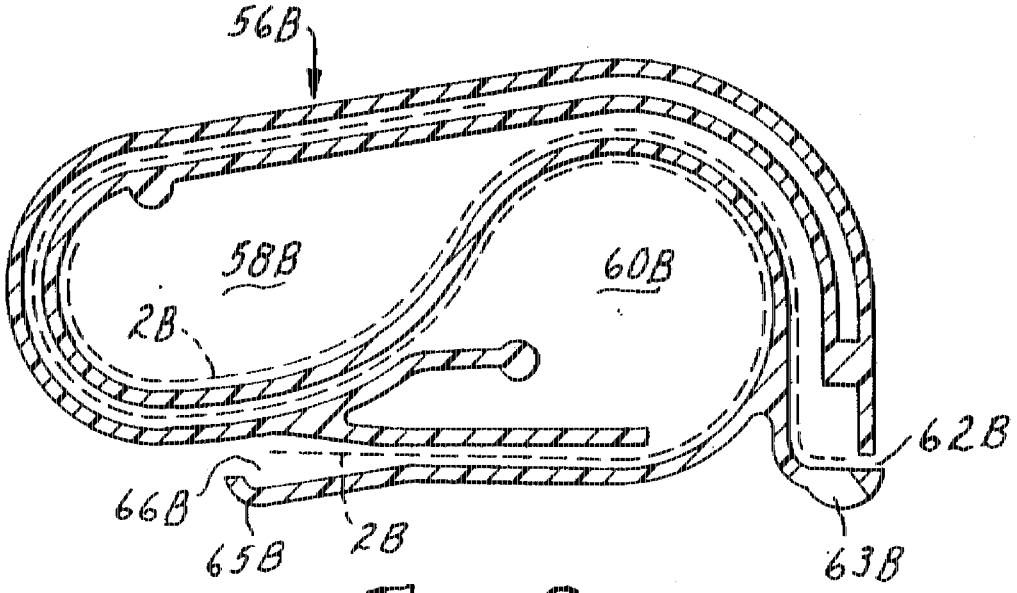
FIG. 9 is a side sectional view of another embodiment of the sheet cartridge shown in FIG. 7.
Figure 10:
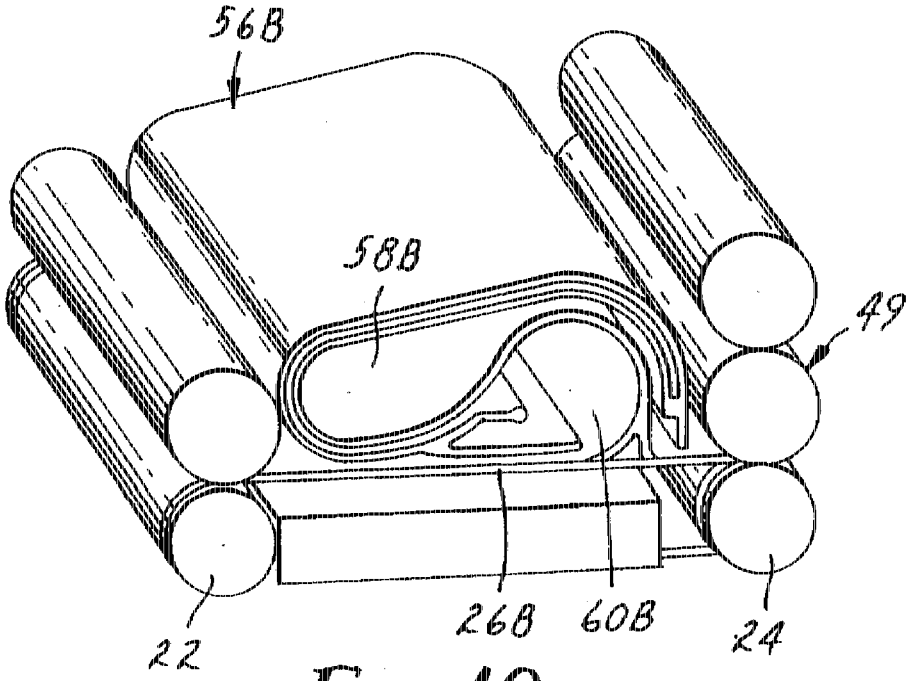
FIG. 10 is a perspective view of the sheet cartridge shown in FIG. 9 positioned within the transport mechanism of an electrophotographic apparatus.

A second embodiment of the sheet cartridge 56B is shown in FIGS. 9 and 10. This sheet cartridge 56B can be constructed to work in conjunction with the orientation of the photoreceptive sheet 2B, belts 26B, and fastening web 36B shown in FIG. 5. As shown in 9, the sheet cartridge 56B can include a housing 57B which defines a first chamber 58B for storing and dispensing a new photoreceptive sheet 2B and which defines a second chamber 60B for receiving and storing an expended photoreceptive sheet 2B.

As shown in FIG. 10, the sheet cartridge 56B is positionable above the zone created by the belts 26B so that the photoreceptive sheet 2B can be properly presented and fastened to the belts 26B. When the sheet cartridge 56B is inserted and the electrophotographic apparatus 4 begins to operate, the portion of the new photoreceptive sheet 2B which extends from the first chamber 58B can be driven out of the first chamber 58B and onto the belts 26B by a sheet-driving roller 64B. The sheet-driving roller 64B fits within a roller groove 63B of the sheet cartridge 56B.

Figure 11:
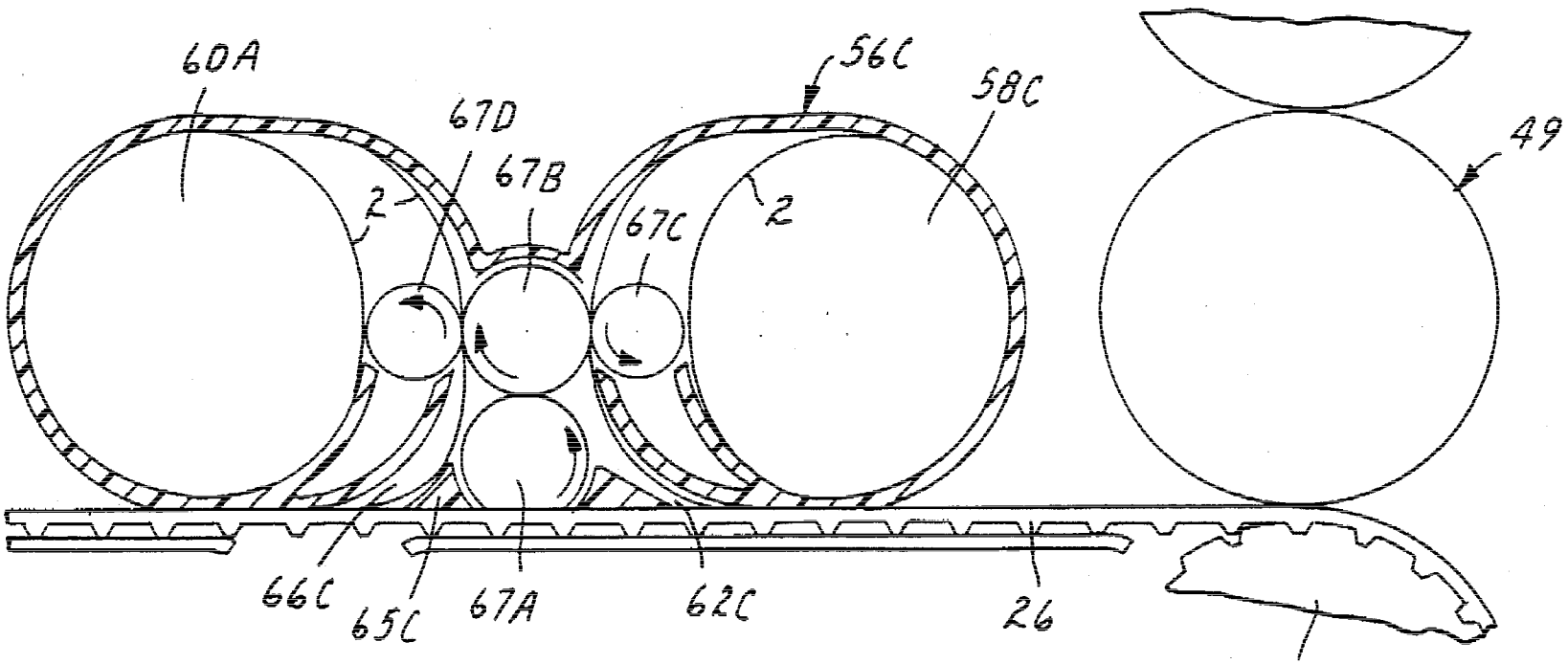
FIG. 11 is a side schematic view of another embodiment of the sheet cartridge from which a new photoreceptive sheet is being dispensed and by which an expended photoreceptive sheet is being received.

A third embodiment of sheet cartridge 56C is shown in FIG. 11 as including internal sheet-driving rollers 67. The lower internal sheet-driving roller 67A can ride on and be driven by the belts 26. The lower internal sheet-driving roller 67A can, in turn, drive three other internal sheet-driving rollers 67B, 67C, 67D. Internal sheet-driving rollers 67B, 67C can feed out a new photoreceptive sheet 2 from the sheet cartridge 56C, while internal sheet-driving roller 67B, 67D can draw an expended photoreceptive sheet into the sheet cartridge 56C.

Figure 12:
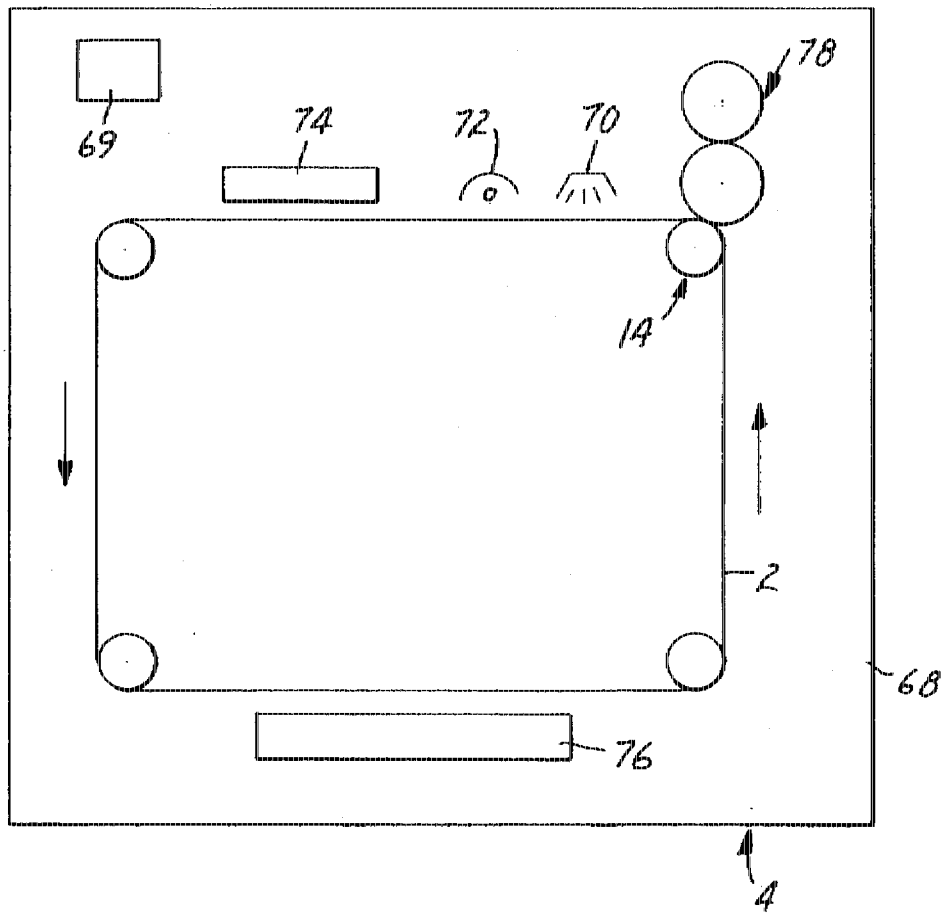
FIG. 12 is a side sectional view of an electrophotographic apparatus which includes the photoreceptive sheet.

The electrophotographic apparatus 4 is shown in FIG. 12 as also including an apparatus housing 68, a control mechanism 69, an erasure lamp 70, a charging means 72, an exposure station 74, an ink deposition mechanism or developer 76, and an ink transfer mechanism 78. The exposure station 74 includes a radiation source which projects radiation to the photoreceptive sheet 2 in an image-wise pattern corresponding to a first image to create a latent image. The first image can be extracted from a copy sheet (not shown) by the electrophotographic apparatus 4.

After the previously noted first transport mechanism 14 transports the photoreceptive sheet 2 around the transport loop, the ink deposition mechanism 76 deposits ink (not shown) onto the photoreceptive sheet 2. The ink, then, migrates on the photoreceptive sheet 2 to form a pattern that closely matches the latent image. The ink transfer mechanism 78 transfers the ink on the photoreceptive sheet 2 to a receptor, i.e., the input sheet (not shown), not unlike the transfer step when using a photoreceptive drum. A second transport mechanism (not shown) transports the input sheet to the ink transfer mechanism 78. The control mechanism 69 controls the first transport mechanism 14 and second transport mechanism, exposure station 74, ink deposition mechanism 76, and ink transfer mechanism 78.

Many other embodiments similar to those previously stated are apparent and contemplated by the inventors. A first example of another embodiment is a different transport mechanism that transports the sheet 2 in a reciprocating motion (i.e., a back-and-forth motion), rather than a circular or looping motion. The sheet cartridge 56 could still be useful with the reciprocating motion of the sheet 2.

Another embodiment could involve an electrophotographic apparatus 4 which simultaneously utilizes two or more photoreceptive sheets 2 within, for example, the transport loop, rather than a single photoreceptive sheet 2 traveling around the transport loop. A gap 52 could exist between each of the sheet ends. It is contemplated that four photoreceptive sheets 2 could be used, one for each ink color (e.g., cyan, magenta, yellow, and black).

Another embodiment could involve an electrophotographic apparatus 4 which includes a transporting mechanism similar to the paper-feeding mechanism found in computer printers and photocopiers. Typically, a paper-feeding mechanism inserts the sheet into the toner and fuser and then out of the machine. In this case, the photoreceptive sheet 10 would feed through a circular or belt like path so that it returns to the same initial position. Similar forward feed mechanisms to those found in paper path feed designs would be needed for the photoreceptive sheet pickup from a paper-like tray.

With this type of mechanism, the photoreceptive sheet 10 can be fed or pulled through its loop with precise speed control. To control the tension across the photoreceptive sheet 10, an additional mechanism can be incorporated into positions within the path where the photoreceptive sheet 10 requires tension control. Each photoreceptive sheet could be repeatedly used within the electrophotographic printer 4 until replacement is necessary. Or, at the option of the operator, the photoreceptive sheet 10 could be replaced via a software control command.

Using this paperfeed-like mechanism, a mechanism for maintaining tension within photoreceptive sheet can include drive rollers near the side edges of the photoreceptive sheet which are slightly canted to impart the cross-web (i.e., cross-sheet) tension. Another approach could include a stiffer track to keep the tension on the web. Still another approach would involve a curved photoreceptive sheet path, for example, transporting the photoreceptive sheet around shafts such that the sheet is always or is primarily flexed. Every time the path bends, even by a few degrees, it stiffens the photoreceptive sheet and prevents cross-sheet bending or buckling.

While possibly increasing the complexity of the transporting mechanism, this paperfeed-like mechanism may allow for a more simplified photoreceptive sheet cartridge. More specifically, a number of photoreceptive sheets could be stacked in a "paper tray"-like cartridge. The tray would supply the new sheet and have a compartment for the disposal of the used sheet. This would allow for inserting tens or hundreds of OPR sheets at a time into a machine and reduce operator interaction for fast, high volume print applications.

What is claimed is:

1. An imaging apparatus, comprising:

an apparatus housing;

radiation means within the housing for directing an image-wise pattern of radiation;

a sheet-transporting mechanism positioned within the housing;

a photoreceptive sheet positionable within the housing such that the photoreceptive sheet can capture an image corresponding to the image-wise pattern, the photoreceptive sheet being transportable through a sheet path by the sheet-transporting mechanism; and a sheet cartridge positionable within the housing for storing the photoreceptive sheet and from which the pohotoreceptive sheet can be removed when transported by the sheet-transporting mechanism.

2. The imaging apparatus of claim 1, further comprising:

an erasure lamp positioned within the housing adjacent to the sheet path;

a charging means positioned within the housing adjacent to the sheet path;

an ink deposition mechanism positioned within the housing adjacent to the sheet path; and an ink transfer mechanism positioned within the housing adjacent to the sheet path.

3. A cartridge adapted for storing a photoreceptive sheet and for allowing the photoreceptive sheet to be dispensed to a sheet-transporting mechanism within an imaging apparatus, the cartridge comprising a housing which defines a first chamber in which the photoreceptive sheet can be stored, the housing having an outlet functionally communicating with the first chamber and the sheet-transporting mechanism, the first chamber being shaped such that the photoreceptive sheet is substantially flat when stored within the first chamber.

4. A cartridge adapted for storing a photoreceptive sheet and for allowing the photoreceptive sheet to be dispensed to a sheet-transporting mechanism within an imaging apparatus, the cartridge comprising a housing which defines a first chamber in which the photoreceptive sheet can be stored, the housing having an outlet functionally communicating with the first chamber and the sheet-transporting mechanism, the housing further defining a second chamber in which the photoreceptive sheet can be stored after the photoreceptive sheet is transported by the sheet-transporting mechanism, the housing having an inlet functionally communicating with the second chamber and the sheet-transporting mechanism.

5. The cartridge of claim 4, the second chamber being shaped such that the photoreceptive sheet is rolled when the photoreceptive sheet is transported into the second chamber.

6. A cartridge adapted for storing a photoreceptive sheet and for allowing the photoreceptive sheet to be dispensed to a sheet-transporting mechanism within an imaging apparatus, the imaging apparatus including a transporting component for transporting the sheet within the apparatus, the cartridge comprising:

a housing which defines a first chamber in which the photoreceptive sheet can be stored, the housing having an outlet functionally communicating with the first chamber and the sheet-transporting mechanism; and a plurality of sheet-driving rollers within the cartridge for driving the photoreceptive sheet from the cartridge, the plurality of sheet-driving rollers being configured to feed the expended photoreceptive sheet from the apparatus into the second chamber, and the plurality of sheet-driving rollers comprising:

a first roller extending from the cartridge and being driveable by the transporting component;

a second roller positioned adjacent to and driveable by the first roller;

a third roller positioned adjacent to and driveable by the second roller, the third roller being positioned within the cartridge to contact and drive the sheet from the first chamber; and a fourth roller positioned adjacent to and driveable by the second roller, the fourth roller being positioned to drive the expended sheet to the second chamber.

7. A method for introducing a photoreceptive sheet to an imaging apparatus, the method comprising the steps of:

providing a cartridge containing the photoreceptive sheet, the cartridge comprising a housing defining a first chamber and a second chamber for storing at least one photoreceptive sheet; and providing a sheet-transporting mechanism within the imaging apparatus, the sheet-transporting mechanism being capable of removing the photoreceptive sheet from the cartridge and transporting the photoreceptive sheet within the imaging apparatus.

8. A cartridge for use with an imaging apparatus which has a photoreceptive sheet-transporting mechanism, the cartridge comprising:

a housing; and a photoreceptive sheet within the housing, the photoreceptive sheet being capable of capturing and storing an electrostatic image; wherein the housing and photoreceptive sheet can be positioned relative to the photoreceptive sheet-transporting mechanism such that the photoreceptive sheet can be dispensed from the housing and transported through a portion of the imaging apparatus.

9. The cartridge of claim 8, the housing being shaped such that the photoreceptive sheet is curved when stored within the cartridge.

10. The cartridge of claim 8, the housing being shaped such that the photoreceptive sheet is rolled when stored within the cartridge.

11. The cartridge of claim 8, the housing being shaped such that the photoreceptive sheet is substantially flat when stored within the cartridge.

12. The cartridge of claim 8, the housing defining a first chamber in which the photoreceptive member is stored and defining an outlet functionally communicating with the first chamber and the sheet-transporting mechanism.

13. The cartridge of claim 8, the imaging apparatus including a sheet-driving roller, and the cartridge having a roller groove to receive the sheet-driving roller such that the sheet-driving roller can contact the photoreceptive sheet within the housing.

14. The cartridge of claim 8, further comprising a plurality of sheet-driving rollers within the cartridge for driving the photoreceptive sheet from the cartridge.

* * * * *